United States Patent [19]

Nemit et al.

[11] 4,070,639

[45] Jan. 24, 1978

[54] MICROWAVE 180° PHASE-BIT DEVICE WITH INTEGRAL LOOP TRANSITION

[75] Inventors: Jeffrey T. Nemit, Canoga Park; Bobby J. Sanders, Pacoima, both of Calif.

[73] Assignee: International Telephone and Telegraph Corporation, New York, N.Y.

[21] Appl. No.: 755,630

[22] Filed: Dec. 30, 1976

[51] Int. Cl.[2] ..... H01P 1/18; H01P 1/15

[52] U.S. Cl. ..... 333/31 A; 333/31 R; 333/84 M

[58] Field of Search ..... 333/31 A, 7 D, 84 M

[56] References Cited

U.S. PATENT DOCUMENTS

| | | | |
|---|---|---|---|
| 3,518,688 | 6/1970 | Stayboldt et al. | 343/771 |
| 3,568,097 | 3/1971 | Hyltin | 333/31 X |
| 3,803,621 | 4/1974 | Britt | 343/821 |
| 3,916,349 | 10/1975 | Ranghelli et al. | 333/31 R |

*Primary Examiner*—Alfred E. Smith
*Assistant Examiner*—Charles F. Roberts
*Attorney, Agent, or Firm*—William T. O'Neil

[57] ABSTRACT

A 180° microwave phase-bit device implemented in a stripline medium with integral transitional coupling into a waveguide by means of an H plane loop within the waveguide. The device is particularly well suited for use in digital diode phase shifters attached to waveguide feed networks, such as in the case of corporate feed of plural antenna elements within a phased array. The device is shown both independently and in connection with diode phase shifters providing intermediate values of phase shift such as 22°, 45° and 90°. PIN type radio frequency diodes would normally be used to provide the necessary switching function.

10 Claims, 4 Drawing Figures

MICROWAVE 180° PHASE-BIT DEVICE WITH INTEGRAL LOOP TRANSITION

BACKGROUND OF THE INVENTION

The invention relates to microwave phase shifters such as are commonly used in phased array technology.

DESCRIPTION OF THE PRIOR ART

In phased array technology, electronically controlled phase shifters have been applied for the provision of inertialess scanning. In the text *Radar Handbook* by Merrill I. Skolnik (McGraw Hill Book Company, 1970), Chapter 11 is devoted entirely to phased-array systems. Chapter 12 of the same text is devoted to the subject of phase shifters for such arrays. From this, it becomes apparent that much development effort has been expended in this area, and a feeling for the relatively recent state of this art can be gained.

Comparatively recently, so-called PIN-type diodes have been employed in stripline (microstrip) transmission line media to effect switching of microwave energy. Still more recently, the digital phase shifter (in the stripline medium) has evolved and has provided the capability for phase shifting in binary significance patterns in the same integrated device. These binary bit significances might be, for example, 22°, 45°, 90° and 180°. Such a device is described in an article entitled, *Integrated Diode Phase-Shifter Elements for an X-Band Phase-Array Antenna,* which appeared in the IEEE transactions on microwave theory and techniques (December, 1975). In addition, U.S. Pat. No. 3,803,621 provides pertinent background for the present invention in that it shows a known implementation of a 180° phase shifter by reversing the polarity of the signal in the antenna. That particular prior art is most relevant in systems where the phase shifter is extant directly behind an individual radiating element of a phased array, since it does not contemplate the transition to another transmission line media, such as waveguide.

Other prior art devices for achieving the 180° digital phase bit have consisted predominantly of either the hybrid-coupled approach, the use of multiple sections of periodically loaded lines, or the switched line approach. Ordinarily, the provision of a transitional coupling between two different types of transmission media, for example from stripline to waveguide, has been treated separately from the phase shifter structure.

From the point of view of cost effectiveness, material conservation and minimization of weight and complexity, there has been a very significant need for simplification by integrating the transitional coupling into the phase shift device. The manner in which the present invention furthers the state of this art by providing such a device will be evident as this description proceeds.

SUMMARY OF THE INVENTION

An integrated circuit approach has succeeded in uniquely combining the function of a 180° phase-bit with that of a loop transition. The circuit comprises a combination including a power divider, two symmetrical shunt-diode RF switching arrangements and a magnetic coupler. Although the invention in its most basic form could be implemented in some other transmission line medium such as in coaxial transmission line, the stripline medium employed is considered preferable because of low cost and the ease with which stripline apparatus can be manufactured.

The aforementioned power divider is supplied by branching the central stripline conductor. These branches each feed a tapered stripline section operating as an impedance transformer, one each to one of the terminals of a loop coupler. This loop coupler is integral with an arrangement of stripline sections, the 180° phase shift capability being afforded by supplementary control of two associated diode switching arrangements. That is to say, supplementary control herein means that one diode is biased by a control signal into the conducting condition while the other is back biased and vice versa. This supplementary control of the diode switching devices as a pair provides the basis for RF current reversal, selectively, in the loop. Use is made of the fact that, by appropriate arrangement of quarter wave transmission lines sections in cooperation with the switching diodes, the branches comprising the power divider may be made to alternately pass and inhibit the energy flow from the central stripline conductor (in transmitting operation) at the point of branching. The device is, of course, reciprocal, and therefore operates on receiving as well as transmitting.

The device of the invention provides some unique advantages vis-a-vis the hereinbefore discussed prior art, including:

a. Reduced space and area required for the combined 180° phase shift and stripline to waveguide transition functions.

b. Lower manufacturing cost.

c. Lower insertion loss overall d. Greater active bandwidth.

e. Substantial absence of amplitude modulation between phase states.

The details of a preferred embodiment according to the present invention will be understood as this discussion proceeds.

DESCRIPTION OF THE PREFERRED EMBODIMENT

Figure 1A:
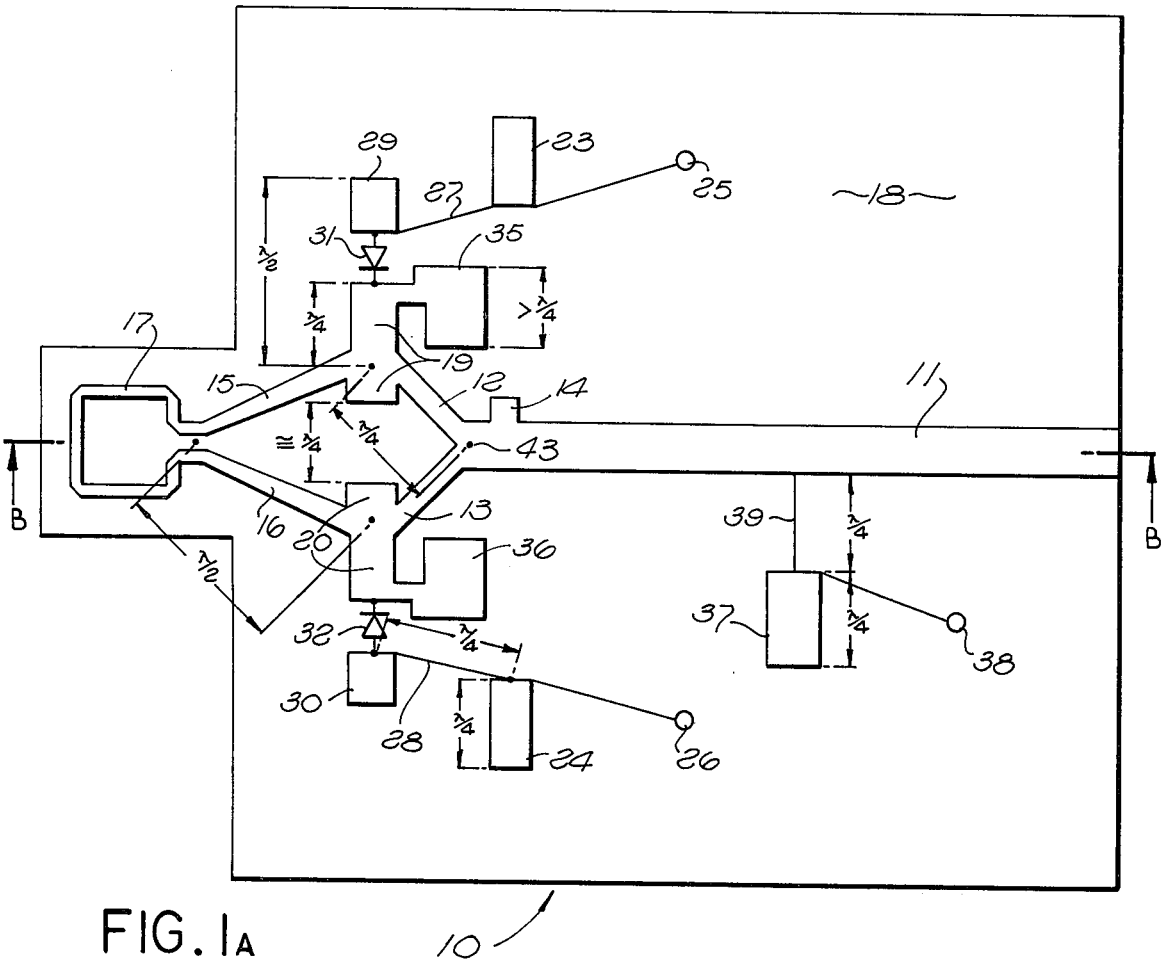
FIG. 1A is a schematic/physical layout of the strip transmission line components in the plane of the central stripline conductor according to the invention.
Figure 1B:
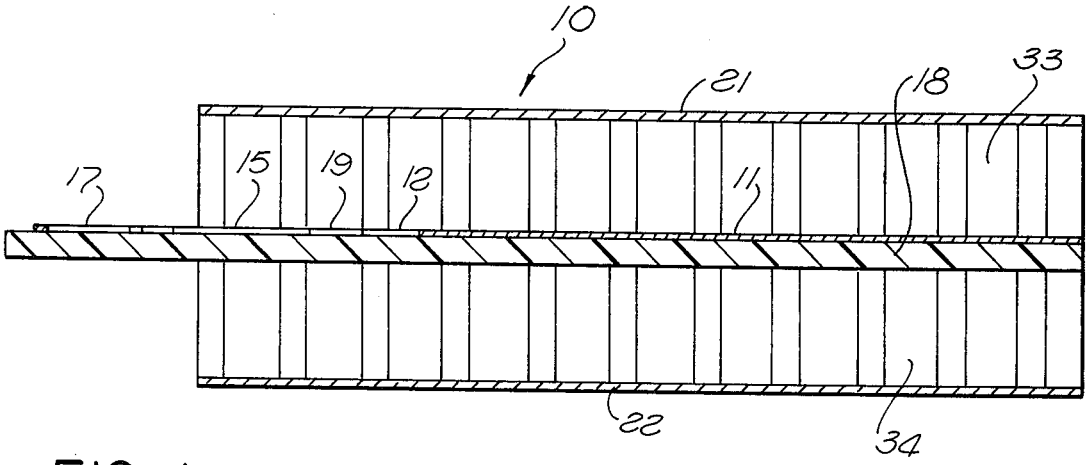
FIG. 1B is a sectional view of the physical structure of FIG. 1A taken as indicated.

Referring now to FIG. 1, a top view or layout of the stripline circuitry of a typical embodiment of the present invention is shown. In FIG. 1A, it is assumed that the top shield or ground plane 21 and the honeycomb insulating support material 33 as shown in FIGS. 1B and 2 have been removed for clarity.

Although it is to be understood that the combination according to the present invention is entirely reciprocal, it will be described in the transmitting mode for convenience, that is, assuming that energy from an RF generator of some sort is applied at the right end of the stripline member 11 as seen in FIG. 1A. It may also be assumed that the stripline extends farther to the right on FIGS. 1A and 1B, as required by the utilization, and that the sandwich-type configuration illustrated in FIGS. 1B and 2 also continues. Basically, all the stripline elements are "printed" onto an insulating or dielectric substrate 18. Insulating spacing material 33 and 34 in the form of honeycomb, such as described in U.S. Pat. No. 3,518,688, for example, is shown. This honeycomb material serves to mechanically separate and space the conductive planes 21 and 22 which are typical of stripline structure in general. It will be understood, however, that there are other known techniques and structures which can provide the same function as the honeycomb material 33 and 34.

Figure 2:
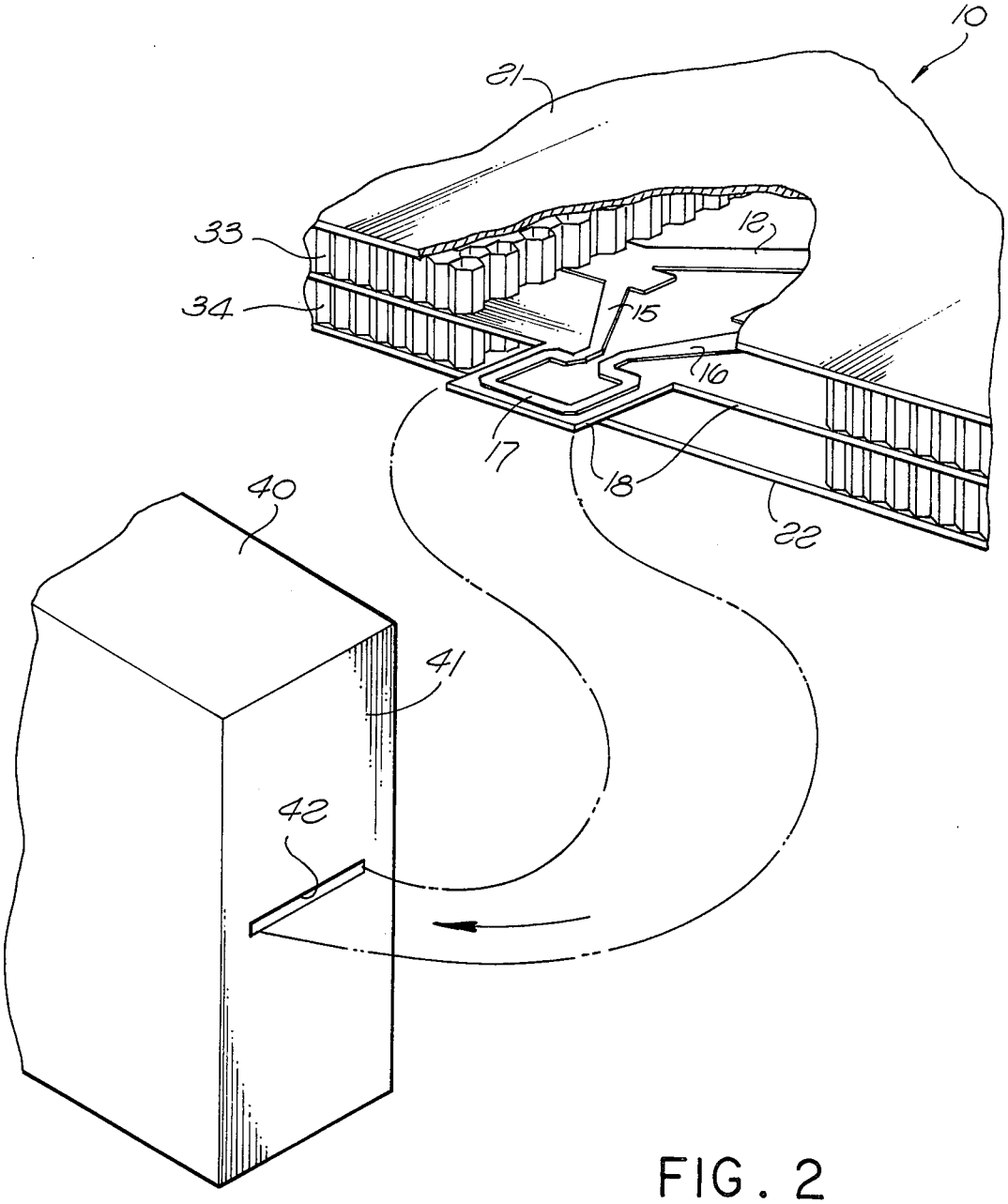
FIG. 2 is a partially exploded pictorial illustrating the stripline shifter according to the invention with its shield planes or outer conducting plates and supporting insulation, the rectangular waveguide for receiving the transition loop being also included.

Looking ahead to FIG. 2, the typical assembly illustrating the stripline-to-waveguide transition according to the present invention is depicted. The rectangular waveguide 40 with a closed metallic end place 41 having a slot 42 receives the loop 17 which is an integral part of the printed circuitry of FIG. 1A. This will be recognized by those skilled in this art as an integral H plane coupling or transition coupling the stripline and waveguide transmission line media.

The characteristics of the honeycomb material 33 and 34 are set forth in the aforementioned U.S. Pat. No. 3,518,688, and a type of dielectric material suitable for carrier plane 18 would be well known in this art. Basically, the same criteria as would apply to straight-forward stripline design also apply, namely, that a material with a low tangential loss would be preferred. The conductive planes 21 and 22 might be of a conductive material such as copper or might actually be metal cladding on insulating panels, that alternative being also described in the aforementioned U.S. Pat. No. 3,518,688.

As is well known in connection with strip transmission line or microstrip line design, relatively wide printed conductors correspond to low characteristic impedance, whereas, narrow printed conductive lines denote higher characteristic impedance. A typical characteristic impedance for the input line 11 is 50 ohms, for example, whereas conductive lines 27, 28 and 39 might typically be on the order of a 150 ohms representative impedances.

The provision of a 180° phase shift involved reversal of the current in the loop 17. That is, if one direction of current represents zero phase, the other direction of current through loop 17 represents 180° phase. Each of the diodes 31 and 32 acts to effectively switch the energy extant along 11 between the branches 12 and 13. That is, each of the diodes when forward biased (conducting condition) operates to pass energy in the corresponding branch circuits. Still more explicitly, when diode 31 is forward biased, the energy from 11 can flow through branches 12 and 15 into loop 17. Since, at the same time, diode 32 is back-biased, energy from 11 would be rejected at the input of branch 13. Accordingly, these branches 12 and 13 comprise a power divider and point 43 may be thought of as the dividing point. In the converse condition, that is, with diode 32 conducting and 31 back-biased, energy flows through 13 and 16 into the other side of the loop but not from 11 into 12.

The one diode and corresponding branches in the "isolate" (no pass) condition, by virtue of the layout and quarter-wave multiples extant between diode and loop, operates to place an effective short-circuit termination (hard short) at one terminal of the loop. This provides a good coupling into the waveguide with low insertion loss. Because of the inherent symmetry, reversing the diode biasing control complementary signal pair (terminals 25 and 26) causes the switch previously operating in the pass state to switch to the isolate state and vice versa. The branches corresponding to the pass state switch now convey energy to the other side of the loop and the short circuit termination is moved to the other loop terminal. This, it will be realized, reverses the current flow in loop 17 and effects the desired phase shift from 0° to 180° or 180° to 0° ).

The various sections of stripline circuitry are constructed in quarter wavelength and multiples thereof where the switching or isolating filter functions are involved. These are marked in terms of fractions of a wavelength on FIG. 1A and it will be realized, of course, that none of the Figures are deliberately to scale and are actually enlarged from specific layouts designed for operation in the X-band.

The loop 17 is on the order of a quarter wave on the side or a full wave completely around the loop.

It will be noted that the branches 12 and 13 fanning out from the power divider 43 are smaller in width. If the line section 11 is taken as 50 ohms characteristic impedance, then each of 12 and 13 would be designed for 70.7 ohms characteristic impedance. The actual match at this power division point 43 is trimmed through the use of a matching step 14.

The branches 15 and 16 comprise a pair of tapered conductors converging on the loop and are each a half wavelength as shown in FIG. 1A Branches 15 and 16 constitute an impedance transformer whereby the 70.7 ohm characteristic impedance extant at their connections stubs 19 and 20 convert up to an impedance on the order of 100 ohms at the loop connections (terminals of the loop). The stubs 19 and 20 are tailored to provide capacitance to enhance the quality of electronic swtiching effected by the device.

It will be noted from FIG. 1A that a quarter-wave spacing from the mutual junction point of 12, 19 and 15 to the nearest terminal of diode 31 is a quarter wavelength and from the point to the diode and the outboard stub 29, an electrical half wavelength is provided. Since the circuit is entirely symmetrical about the longitudinal center of 11, except for matching stub 14 and the components 37 and 39 associated with terminal 38, these quarter and halfway dimensions apply likewise to stubs 20, diode 32 and outboard stub 30. The shunt capacitance stub 35 is indicated to have a length somewhat greater than a quarter wavelength, and the same applies to 36. These stubs provide the shunt capacitance needed to create the proper reactance loadings when the diodes are reverse biased. Here again, quality of switching is the purpose.

The control signals, which are actually biasing signals for the diodes 31 and 32, are supplied through terminals 25 and 26, respectively. Each of these bias control signal inputs has an RF filter network to isolate the DC terminals represented by 25 and 26 from the active radio frequencies extant on the diodes 31 and 32 during operation. Each of these isolation networks includes a series quarter wave high impedance stub 27 and a parallel lower impedance stub 23 in the case of terminal 25 and high impedance quarter wave stub 28 along with lower impedance quarter wave stub 24 in the case of terminal 26. The terminals 25 and 26, being the diode bias control signal inputs, are isolated in an RF sense by means of the filter configurations hereabove described. The return circuit for the bias control signals applied at 25 and 26 in complementary relationships is terminal 38. The control signal return path to 38 passes through the stripline components as will be evident from FIG. 1A. Radio frequency isolation of the terminal 38 is effected by the relatively high impedance quarter wave stub 39 and the relatively low impedance stub 37 operating in the same manner as already described in connection with stubs 27 and 23 or stubs 28 and 24 for isolating the control signal terminals 25 and 26, respectively.

Figure 3:
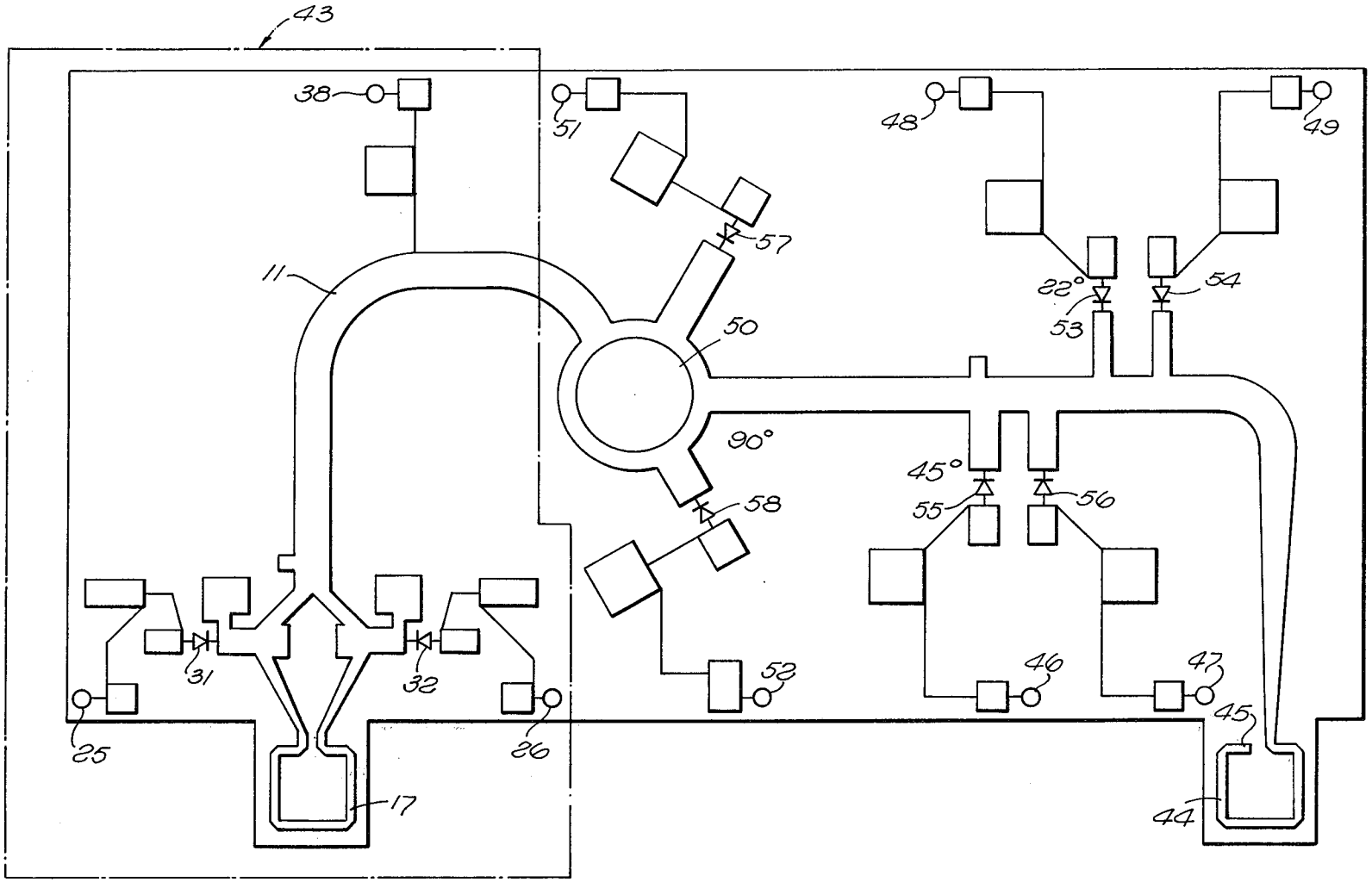
FIG. 3 illustrates the manner in which stripline phase shifters of lesser bit significance can be assembled, with the 180° shifter according to the present invention, to form a practical digital phase shift device.

Referring now to FIG. 3, the 180° phase bit according to the invention is shown combined with an arrangement of intermediate phase bits providing discrete 22°, 45° and 90° phase shift values as well as 180°. Taken together with the 180° phase bit capability of the combination of the invention, this might be regarded as a practical four-bit digital phase shifting arrangement.

The 180° phase shift portion of FIG. 3 is that within the dotted block 43. The input stripline section 11 is shown for identification, as are the loop 17 and the diode control terminals 25 and 26 for controlling the operation of diodes 31 and 32, respectively. The stripline circuit elements shown within 43 are readily identifiable with reference to FIG. 1A.

In FIG. 3, it is assumed that the stripline conductor 11 is fed from an output port of a hybrid-coupled phase bit 50. All of the circuitry to the right (as shown on FIG. 3) of the dotted block 43 comprises the 22°, 45° and 90° phase shifter components, which although not a part of the invention per se, are shown for utility and completeness. Known diodes and stripline phase shifter concepts are applied to produce the discrete phase bit values of 22°, 45° and 90°, as is well understood in this art.

The loop 44 which may constitute an input to the entire device of FIG. 3 has a hard ground at 45. Differential control RF diode bias signals are appropriately applied to 48 and 49 for diodes 53 and 54, respectively, to provide zero or 22° phase shift in accordance with the relative control signal values at 48 and 49. Similarly, a 45° phase bit is provided in accordance with bias control signals at 46 and 47, controlling RF diodes 55 and 56, respectively. Still further, the diodes 57 and 58, in cooperation with the 3-dB hybrid coupler 50, can be controlled in accordance with signals 51 and 53, respectively, to provide a zero or 90° phase bit. Finally, the terminal 38 provides a control signal return path for all diode control signals of FIG. 3.

As hereinbefore indicated, the relationships in FIG. 1B and FIG. 2 should now be clear so that the construction of the device according to the present invention will be well understood.

The general design criteria for the construction of strip transmission lines are well understood by those skilled in this art and are applicable in the device of the invention. Accordingly, those dimensions, spacings and other details not specifically set forth in the drawings of this specification may be readily implemented by persons of skill in this art.

Various modifications, will suggest themselves to the skilled practitioner, and accordingly, it is not intended that the drawings or this specification should be considered as limiting the scope of the invention, these being intended to be typical and illustrative only.

What is claimed is:

1. An integral device including a 180° selective microwave phase bit device and transitional coupling operative between waveguide and a second transmission line medium, comprising:

a conductive loop in a plane orthogonal with respect to the longitudinal axis of said waveguide, said plane being located to place said loop within said waveguide to provide magnetic coupling between said loop and the energy within said waveguide;

said loop being connected to provide a first port for said device;

means providing a second port in said second transmission line medium, said phase bit device being operatively connected between said first and second ports;

at least a first control terminal for receiving at least a first control signal;

and a microwave energy switching arrangement within said phase shifter, responsive to said first control signal to establish a first direction of current flow in said loop in response to the microwave signal at said second port for a first condition of said control signal and a second direction of current flow in said loop for a second condition of said control signal.

2. Apparatus according to claim 1 in which said phase shifter is further defined as including a power divider connected to said second port, said power divider providing a pair of transmission line branches, in which said switching arrangement comprises first and second microwave switching elements having first and second control terminals, respectively, said control terminals being responsive to a pair of first and second control signals, respectively, said control signals being always of opposite sense between themselves and selectively interchangeable to control said first switching element into a conducting condition and said second switching element into a contemporaneous non-conducting condition and selectively to control said second switching element into a conducting condition and said first switching element into a contemporaneous non-conducting condition, and a circuit of quarter wave stubs and integral multiples thereof connected to each of said branches with a corresponding one of said switching elements interconnected therewith to correspondingly provide said first and second current directions in said loop corresponding to the selectively interchangeable conditions of said pair of control signals.

3. Apparatus according to claim 1 in which said second transmission line medium is stripline, and in which switching arrangement comprises a pair of RF diodes, said control signal is a pair of biasing signals of mutually opposite sense, and said biasing signals are applied to said diodes through the conductors forming said stripline medium.

4. Apparatus according to claim 3 in which said diodes are defined as PIN type diodes.

5. An integrated, microwave, 180° phase-bit device in a stripline medium with integral transition to a waveguide transmission line, comprising:

first and second branches in the plane of, and connected to the central strip conductor within said stripline, to form a reciprocal power divider;

first stripline circuit means including first and second radio frequency diodes each being controllable to provide conducting and alternate non-conducting conditions as a function of the condition of a switching control, signals applied thereto to effect a radio frequency connection from one of said branches to said central strip conductor, one of said diodes being controlled in said conducting condition while the other is contemporaneously controlled in said non-conducting condition;

a conductive loop in said plane of said central strip conductor, said loop extending into the end of said waveguide to provide H plane coupling thereto;

and second stripline means for connecting the terminals of said loop, one to each of said branches, to produce zero and 180° current flow in said loop alternatively in accordance with the alternative conditions of said switching control signals.

6. Apparatus according to claim 5 in which said first and second branches each comprising a first quarter wave section of stripline and each connected at one end to said central strip conductor;

third and fourth quarter wave stripline sections joining the other ends of each of said first and second quarter wave sections, said forth sections including said diodes, said sections and said diodes forming a controlled switching arrangement for passing and alternatively inhibiting the passage of RF energy between said first and second branches and said central strip conductor.

7. Apparatus according to claim 6 in which said second stripline means comprises a pair of tapered stripline conductors, one connecting each of said other ends of said first and second quarter wave sections to one of said loop terminals, thereby to provide an impedance transformation between said loop and the junctions of said third quarter wave sections connecting to each of said first and second quarter wave sections.

8. Apparatus according to claim 5 in which said diodes are PIN type diodes.

9. Apparatus according to claim 8 in which means are included for applying said switching control signals to said PIN diodes as a back biasing signal to one diode and as a forward biasing signal to the other diode at any given time.

10. Apparatus according to claim 9 in which said means for applying said switching control signals includes control terminals providing biasing connections to said diodes through said stripline means, said biasing connections further including an arrangement of quarter wave stripline stubs at each of said biasing connections to provide isolation of said control terminals from RF signals in said stripline medium.

* * * * *